United States Patent [19]

Abate

[11] Patent Number: 4,615,550

[45] Date of Patent: Oct. 7, 1986

[54] LOCK MECHANISM

[76] Inventor: Gennaro Abate, 19 Ridgewood Ave., Yonkers, N.Y. 10704

[21] Appl. No.: 681,673

[22] Filed: Dec. 14, 1984

[51] Int. Cl.[4] ..... E05C 5/04

[52] U.S. Cl. ..... 292/192; 292/5

[58] Field of Search ..... 292/5, 191, 192, 139, 292/167, 153, DIG. 49

[56] References Cited

U.S. PATENT DOCUMENTS

| | | | |
|---|---|---|---|
| 960,386 | 6/1910 | Obert | 292/139 X |
| 1,083,173 | 12/1913 | Zeckhauser | 292/139 X |
| 1,256,992 | 2/1918 | Edgar et al. | 292/167 |
| 1,872,440 | 8/1932 | Frost et al. | 292/165 |
| 3,912,309 | 10/1975 | Fischer et al. | 292/167 |

*Primary Examiner*—Richard E. Moore

*Attorney, Agent, or Firm*—Bernard Malina

[57] ABSTRACT

A lock mechanism includes a lock case and a sliding bolt which is operated by a pair of link members which are mounted within the lock case. The sliding bolt has a hollow portion and carries a pair of pivotally mounted dead latches. When the sliding bolt is fully extended from the lock case, the dead latches swing out to engage a door jamb. When the sliding bolt is retracted into the lock case, the dead latches pivot into the hollow portion of the sliding bolt.

3 Claims, 6 Drawing Figures

FIG. 1
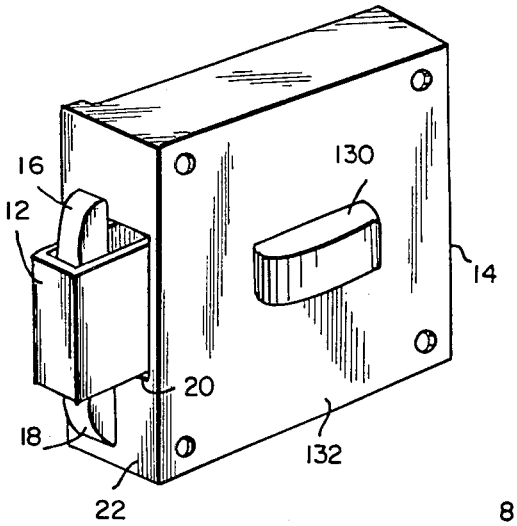
FIG. 2A
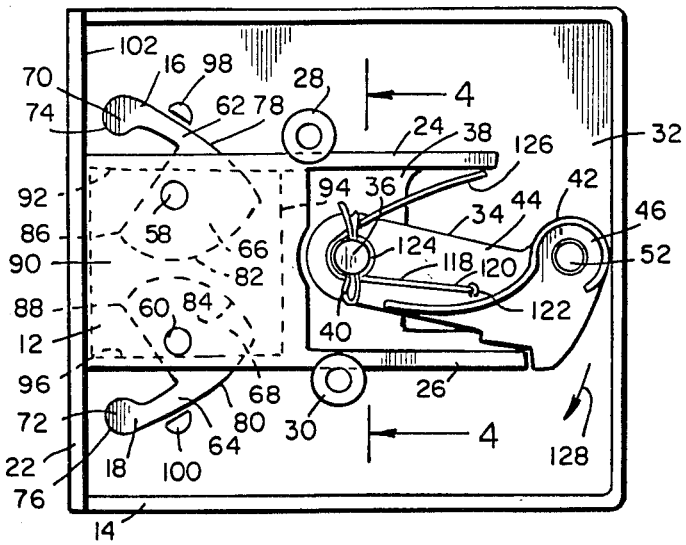
FIG. 2B
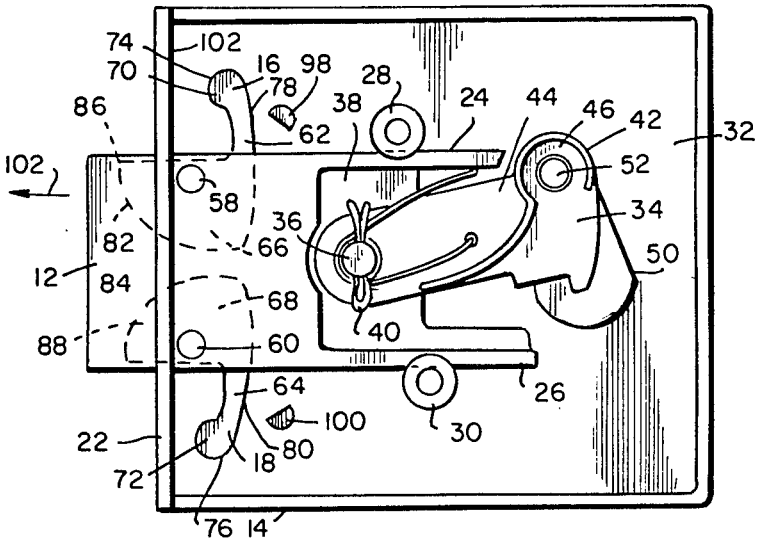
FIG. 3
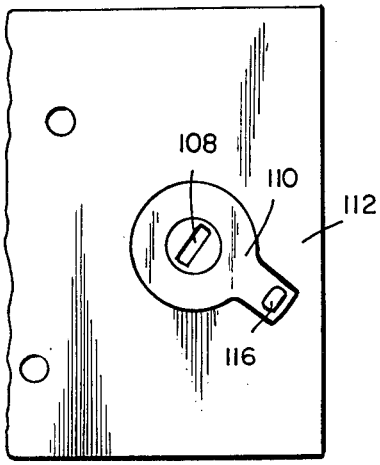
FIG. 2C
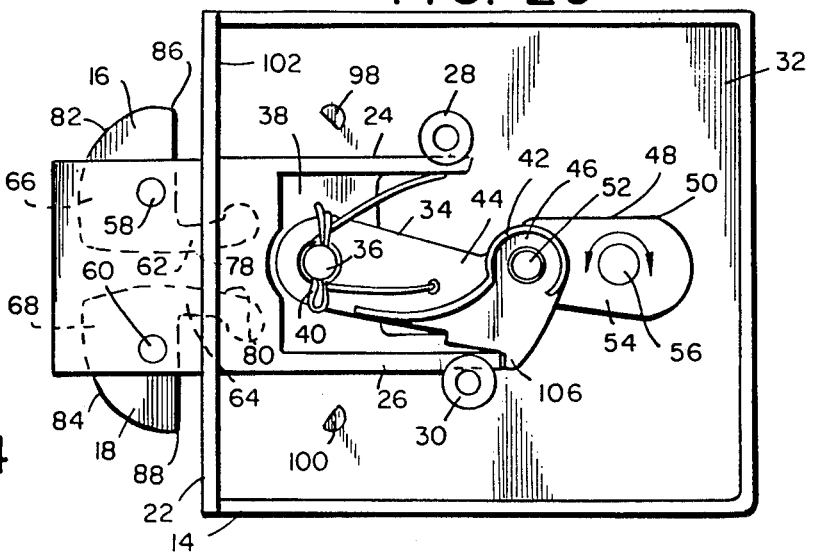
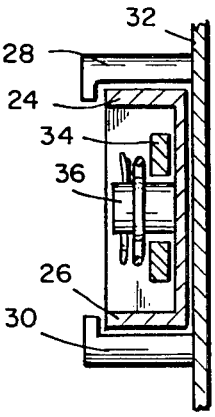
FIG. 4

LOCK MECHANISM

BACKGROUND OF THE INVENTION

As part of a continuing desire for increased security, the field of lock design and manufacture has undergone extensive development. The prior art includes numerous examples of lock mechanisms of various designs each attempting to combine a high degree of security with a relatively simple and inexpensive construction. One of the features found in lock mechanisms having a relatively high degree of security is a dead latch member which is carried by a sliding bolt. The dead latch member is carried by the sliding bolt and when the sliding bolt is extended, moves outwardly from the sliding bolt to engage the door jamb. An example of such a dead latch is shown in U.S. Pat. No. 1,777,951 issued to W. Wolf. The Wolf patent shows a sliding bolt which includes a pair of hooked members which are pivotally mounted. When the sliding bolt is in the retracted position, the hooked members lie within the planes defined by the sides of the sliding bolt. Another example of a dead latch is shown in U.S. Pat. No. 3,175,376 issued to R. G. Cantwell. The Cantwell patent shows a sliding bolt which includes a pair of pivotally mounted members. The devices shown in the Wolf and the Cantwell patents include spring members which act on the pivotally mounted members. The devices are also both relatively complex and costly to manufacture. Other examples of the prior art are shown in U.S. Pat. Nos. 2,163,121, 1,758,203, 1,660,325, 1,714,857, 1,922,043 and German Patent No. 262,859, British Pat. No. 542,299 and French Pat. No. 609,791.

OBJECTS OF THE INVENTION

It is an object of the present invention to overcome the deficiencies of the prior art by providing a lock mechanism having a pair of dead latch members which pivot outwardly from a sliding bolt to engage a door jamb and provide a high degree of security.

Another object of the present invention is to provide a lock mechanism which is extremely reliable in operation.

Still another object of the present invention is to provide a lock mechanism which comprises a relatively small number of component parts which can be manufactured economically at a relatively low unit cost.

SUMMARY OF THE INVENTION

In accordance with the present invention there is provided a lock mechanism which includes a lock case and a sliding bolt having a hollow portion and carries a pair of pivotally mounted dead latches. When the sliding bolt is fully extended from the lock case, the dead latches swing out and engage a door jam. When the sliding bolt is retracted into the lock case the dead latches pivot into a hollow portion of the sliding bolt.

The sliding bolt is operated by a pair of link members which are pivotally mounted in the lock case. The link members are operated by a conventional cylinder lock in order to open or close the lock mechanism from the outside. The lock mechanism may be operated from the inside by a knob which is mounted on the lock case and which is connected to one of the links.

Additional objects and advantages of the invention will become apparent during the course of the following specification, when taken in connection with the accompanying drawings in which:

BRIEF DESCRIPTION OF THE DRAWINGS

FIG. 1 is a perspective view of a lock mechanism in accordance with the present invention;

FIG. 2A is an elevation view of the lock mechanism of FIG. 1, with the cover plate shown removed to reveal internal details of construction, and with the sliding bolt shown in the fully retracted position;

FIG. 2B is an elevation view, similar to FIG. 2A, with the sliding bolt shown in a partially extended position;

FIG. 2C is an elevation view similar to FIG. 2A, with the sliding bolt shown in the fully extended position;

FIG. 3 is a fragmentary elevation view of the inside of the cover plate showing an operator link which is mounted on the cover plate, and FIG. 4 is a fragmentary cross-sectional view taken along the line 4—4 of FIG. 2A.

DETAILED DESCRIPTION OF THE INVENTION

With reference to the drawings, there is shown in FIG. 1 a lock mechanism 10, made in accordance with the present invention, which comprises a sliding bolt 12, which is mounted in a lock case 14, and a pair of pivotally mounted dead latches 16, 18 which are mounted on the sliding bolt 12 and which swing outward when the sliding bolt 12 is fully extended.

As is best shown in FIGS. 1, 2A, 2B and 2C, the sliding bolt 12 projects through an aperture 20 in the wall 22 of the lock case 14 and includes wall portions 24, 26 which are guided by pin members 28, 30 which project from the back wall 32 of the lock case 14. The sliding bolt 12 is pivotally connected to a first link 34 by a pin 36 which is mounted on the wall portion 38 and the pin 36 is secured by the cotter pin 40. The first link includes an arcuate rim portion 42, which projects from the surface 44. The operation of the rim portion 42 will be described presently.

The end 46 of the first link 34 is pivotally connected to the end 48 of a second link 50 by a pin 52. An intermediate portion 54 of the second link 50 is pivotally connected to the back wall 32 of the lock case 14 by a pin 56.

The dead latches 16, 18 are symmetrical in configuration and are pivotally connected to the sliding bolt 12 by the pins 58 and 60. The dead latches 16, 18 include arm portions 62, 64 which project from the central portions 66, 68. The ends 70, 72 of the arm portions 62, 64 include convexly rounded protuberances 74, 76 and the edges 78, 80 of the dead latches 16, 18 have a relatively gentle convex curvature. The edges 82, 84 are also convexly curved and form a smooth transition with the edges 78, 80, respectively, with the edges 82, 84 having a relatively smaller radius of curvature than the edges 82, 84. When the sliding bolt 12 is in the fully retracted position, as shown in FIG. 2A, the end portions 86, 88 of the dead latches 16, 18 project into the hollow portion 90 of the sliding bolt 12 which is defined, in part by the walls 92, 94, 96 which are shown in broken lines. The edges 78, 80 of the arm portions 62, 64 bear against the pins 98, 100 which project from the rear wall 32 of the lock case 14 when the sliding bolt 12 is in the position shown in FIG. 2A.

When the sliding bolt 12 moves in the direction shown by the arrow 102 in FIG. 2B, the protuberances 74, 76 bear against the inside surface 102 of the wall 22 of the lock case 14 causing the dead latches 16, 18 to swing outward. When the sliding bolt 12 is in the fully extended position as shown in FIG. 2C the end of the wall portion 26 engages the step portion 106 of the first link 34 and the sliding bolt 12 is thus prevented from moving inwardly until the first link 34 is rotated. In this position the protuberances 74, 76 on the dead latches 16, 18 prevent the dead latches 16, 18 from moving inwardly The lock mechanism 10 is operated from the outside by a conventional cylinder type lock apparatus which is not shown and which includes an operator which engages the slot 108 in the link 110. The link 110 is rotatably mounted on the surface 112 of the cover 114 as is shown in FIG. 3. The link 110 includes a tab 116 portion which engages the rim portion 42 for the purpose of rotating the link 34 in order to extend or to withdraw the sliding bolt 12. The cylinder type lock apparatus may be operated by a key or by a conventional combination lock apparatus.

The lock mechanism 10 includes a spring 118 which has a first end 120 which extends into a hole 122 in the link 34, an intermediate portion 124 which is wound around the pin 36 and a second end 126 which bears against the wall 24 of the sliding bolt 12. The spring 118 urges the link 34 to rotate in the direction shown by the arrow 128 in FIG. 2A. The lock mechanism 10 is operated from the inside by a knob 130 which projects through the wall 132 and is connected to the link 50. Rotation of the knob 130 by an operator rotates the link 50 enabling the operator to extend or to withdraw the sliding bolt 12.

While a preferred embodiment of the invention has been shown and described herein, it is obvious that numerous additions, changes and omissions may be made in such embodiment without departing from the spirit and scope of the invention.

What is claimed is:

1. A lock mechanism for use with a lock having an operator member comprising a lock case, a bolt member, having a hollow portion, with said bolt member slideably mounted in said lock case, with said bolt member capable of a first position, disposed in said lock case, and a second position, disposed extending from said lock case, dead latch means pivotally mounted on said bolt member, with said dead latch means having a first position disposed projecting into said hollow portion of said bolt member, and a second position, projecting outwardly of said bolt member when said bolt member is in said extended position, said dead latch means including an arm portion disposed to engage said lock case and pivot said dead latch means outwardly of said bolt member when said bolt member is in said extended position, said dead latch means being eccentrically pivoted and disposed to swing inwardly when said bolt member is retracted to said first position of said bolt member, link means disposed in said lock case and pivotally connected to said bolt member for extending and retracting said bolt member, said link means comprising a first link member and a second link member with said first link member having a first end pivotally connected to said bolt member and a second end pivotally connected to a first end of said second link member, and with said second link member having a second end pivotally connected to said lock case, with said first and second link members capable of a first position in which said bolt member is disposed in said lock case and said link members are angularly disposed relative to each other, and a second position in which said pivotal connections are in substantial alignment and said bolt member is disposed extending from said case, spring means mounted in said lock case and connected to said first link member with said spring means disposed to urge said first link member toward said second position thereby extending said bolt member, with said first link having a step portion disposed to engage said bolt member when said bolt member is in said second position, guide pin means mounted in said lock case and disposed to guide said bolt member, and connecting means disposed in said lock case and adapted to connect to said operator member of said lock and said link means thereby enabling a user to rotate said link means and extend and retract said bolt member, said connecting means comprising an arm member pivotally mounted in said lock case, with said arm member having a tab portion, and a rim portion projecting from said link means and engaging said tab portion.

2. A lock mechanism in accordance with claim 1 further comprising a knob member connected to said link means and projecting outwardly of said lock case.

3. A lock mechanism according to claim 1 in which said dead latch means comprises a pair of dead latch members.

* * * * *